US007151908B2

(12) United States Patent
Iwai et al.

(10) Patent No.: US 7,151,908 B2
(45) Date of Patent: Dec. 19, 2006

(54) IMAGE FORMING APPARATUS

(75) Inventors: Katsutoshi Iwai, Hachioji (JP); Masaru Ushio, Hachioji (JP); Minoru Asakawa, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 54 days.

(21) Appl. No.: 10/997,788

(22) Filed: Nov. 23, 2004

(65) Prior Publication Data

US 2005/0265764 A1 Dec. 1, 2005

(30) Foreign Application Priority Data

May 25, 2004 (JP) ..... 2004-154417

(51) Int. Cl.
*G03G 15/00* (2006.01)

(52) U.S. Cl. ..... 399/408; 399/407

(58) Field of Classification Search ..... 399/407, 399/408, 409, 410; 270/58.08, 58.07; 412/1, 412/6, 8

See application file for complete search history.

(56) References Cited

U.S. PATENT DOCUMENTS 5,930,551 A * 7/1999 Nakazato et al. ..... 399/1
6,094,546 A * 7/2000 Nakazato et al. ..... 399/1
6,142,721 A * 11/2000 Marsh ..... 412/1
6,213,456 B1 * 4/2001 Hirano et al. ..... 270/58.08
6,553,191 B1 * 4/2003 Nakane ..... 399/38
2006/0029445 A1 * 2/2006 Nakamura et al. ..... 399/329

FOREIGN PATENT DOCUMENTS

JP 09-323488 12/1997
JP 2003-291558 A 10/2003

* cited by examiner

*Primary Examiner*—Ren Yan
(74) *Attorney, Agent, or Firm*—Squire, Sanders & Dempsey L.L.P.

(57) ABSTRACT

An image forming apparatus is capable of connecting to a finisher which requires a warm-up process before use. The image forming apparatus comprises an input port which inputs warm-up information from the finisher, and a controller which controls the image forming apparatus to transport a set of sheets to the finisher regardless of the warm-up information. The set of sheets are subjected to a finishing operation carried out only after completing the warm-up process.

13 Claims, 4 Drawing Sheets

IMAGE FORMING APPARATUS

RELATED APPLICATION

This application is based on Japanese Patent Application No. 2004-154417 filed in Japan on May 25, 2004, the entire content of which is hereby incorporated by reference.

BACKGROUND

1. Field of the Invention

The present invention relates to an image forming apparatus to which a post-processing apparatus (finisher) that needs a warm-up process is connected, and to an image forming system in which such an image forming apparatus and a post-processing apparatuses are coupled.

2. Description of Related Art

There has been widely used a system which couples an image forming apparatus and a post-processing apparatus, and which processes in the post-processing apparatus a plurality of sheets on which images are formed by the image forming apparatus. Recently, there have been proposed various types of post-processing apparatuses provided with a bookbinding function. The bookbinding function makes a stack of sheets by stacking a plurality of sheets conveyed from the image forming apparatus on a sheet stacking tray and then produces a book by binding the stack of sheets.

Among post-processing apparatuses, there are some apparatus that need warm-up until a post-processing function becomes usable. For example, a post-processing apparatus that carries out bookbinding by the use of a hot-melt type adhesive is one example of them. Such a post-processing apparatus is provided with a heating member for melting the adhesive. However, it is not possible to carry out bookbinding operations during a warm-up process of heating the heating member up to the melting temperature of the adhesive.

Conventionally, when using such a post-processing apparatus needing such a worm-up process and an image forming apparatus by connecting them, operations of the image forming apparatus was controlled to start after waiting until the worm-up process has been completed. As a consequence, when using a post-processing apparatus requiring a long warm-up period, the efficiency of the bookbinding operation for the first copy of a book has particularly lowered.

SUMMARY

An object of the present invention is to provide an image forming apparatus that improves the work efficiency when it is used by being connected to a post-processing apparatus needing warm-up, and to provide an image forming system structured by an image forming apparatus and a post-processing apparatus.

The above purpose is achieved by providing an image forming apparatus configured as follows.

An image forming apparatus being capable of connecting to a finisher which requires a warm-up process before use, said image forming apparatus comprises an input port which inputs warm-up information from the finisher, and a controller which controls the image forming apparatus to transport a set of sheets to the finisher regardless of the warm-up information, said set of sheets being subjected to a finishing operation carried out only after completing the warm-up process.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
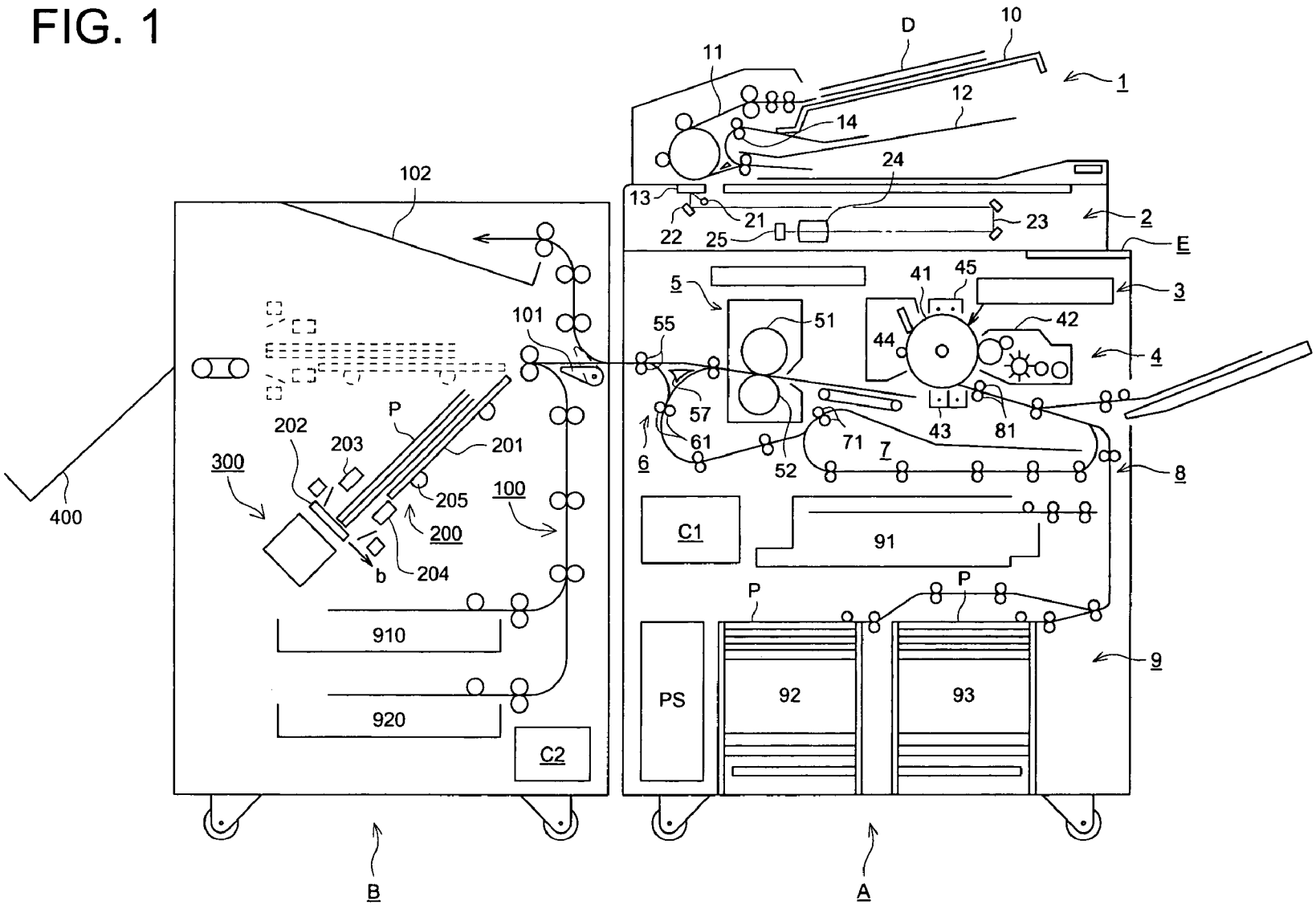
FIG. 1 is an outline concept drawing of the image forming system.

Before explaining a concrete embodiment, firstly a general post-processing apparatuses is explained briefly.

In a post-processing apparatus provided with a bookbinding function, an edge portion of a stack of sheets stacked and aligned on a sheet stacking tray is held such that the sheets do not shift easily. An then the stack of sheets are bound by a binding unit so as to produce a book.

As the binding unit, there may be used so much a unit which binds an edge portion of a stack of sheets with the use of a stapler or another unit which binds a stack of sheets by coating their leading edge surfaces with a hot-melt adhesive being melting. In addition to these units, there has been proposed a unit in which an adhesive is coated on edge portions of sheets discharged from an image forming apparatus, these sheets are stacked up while being aligned, and finally the edge portions of the sheets having been coated with the adhesive are pressed so that the sheets are bound. Each of these binding units described above has their own unique feature so that an appropriate unit is selected in view of the purpose of bookbinding.

When binding a book with a large number of pages, the binding unit employing a stapler is not appropriate from the points of a limitation on the length of a staple pin and uneasiness in opening the book. Further, the binding unit employing coating an adhesive has also problems in the points of security of a proper binding strength and easiness in opening the book. Therefore, since the post-processing apparatus to bind sheets with a hot-melt adhesive has not such problems, it has been used so much.

A procedure of binding a stack of sheets with the use of a hot-melt adhesive may be conducted as follows. Firstly, a binding tape coated with an adhesive as being a bookbinding material is pressed at a predetermined position on edge portions of sheets having been aligned. Next, a member heated to a predetermined temperature is pressed on the back surface of the binding tape so as to transfer an adhesive to the edge portions of sheets by melting the adhesive. The stack of sheets to which the adhesive has been coated is discharged to a stacking tray of the binding apparatus after the adhesive has hardened.

In the heating unit that melts the adhesive on the binding tape by pressing a heated member against it, since it is necessary to heat the binding tape uniformly within a short time, an aluminum material that has good thermal conductivity or a stainless steel that has good heat accumulating ability is used for the heating member. A heater to heat the heating member is provided on a surface of this heating member that is opposite to a surface of the heating member that comes in contact with the binding tape.

Since the heating member is required to have strength to withstand a pressure during its application to the binding tape and to have a uniform temperature distribution, its heat capacity naturally becomes larger. As a consequence, a warm-up period, that is, a period from a time of starting passing an electric current through the heater to a time at that the heating member reaches a predetermined temperature suitable for binding becomes longer. Therefore, even when the preparations of the image forming apparatus have been completed, a waiting time until starting an image forming operation becomes longer.

In order to eliminate this difficulty, it may be considered to shorten the warm-up period by increasing the capacity of the heater and by supplying a large electric power to it. However, usually, there is a limitation on the power that can be supplied by a power distribution board or a power socket to which the apparatus is connected, Therefore, naturally, there is a limitation on the power that can be supplied to the heater. In particular, when a bookbinding apparatus is connected to an image forming apparatus having a fixing unit working with an aid of a heating roller, since it becomes necessary to supply simultaneously electric power to plural heaters for warm-up, an electric power supplied to each of the heaters is inevitably restricted. Accordingly, there may be a tendency that the warm-up period becomes longer more.

Hereinafter, a preferred embodiment related to an image forming apparatus according to the present invention and to an image forming system structured by an image forming apparatus and a post-processing apparatus is described.

FIG. 1 is a schematic view showing an image forming system in which a post-processing apparatus being a bookbinding apparatus an image forming apparatus are coupled to.

The image forming apparatus A is a digital type copying equipment that forms images by using a conventionally known electro-photographic technology. An automatic document feeding apparatus 1 is provided on a upper portion of the image forming apparatus A. Further a bookbinding apparatus B is connected to the image forming apparatus A.

The image forming apparatus A is configured to comprise an automatic document feeding apparatus 1, a reading unit 2, a writing unit 3, an image forming unit 4, a fixing unit 5, a reversing sheet discharge unit 6, a re-feeding unit 7, a sheet transporting unit 8, a sheet feeding unit 9, a control unit C1, and an operation and display unit E, etc.

The automatic document feeding apparatus 1 sends out document D placed on a document placing tray 10 one by one to a document transporting path 11 and discharges the document onto a document discharging tray 12. In the course of transportation, a reading unit 2 reads out an image surface of the document D at a document reading position 13. When reading out images on both sides of the document D, the document D whose $1^{st}$ side has been read out is reversed by a reversing unit 14 and is sent again to the document transporting path 11. And then, the $2^{nd}$ side of the document D is read out. Thereafter, the document is discharged onto the document discharging tray 12.

The reading unit 2 is configured to comprise a light source 21, a first mirror unit 22, a second mirror unit 23, an image forming lens 24, and a CCD device 25, etc. And the reading unit 2 scans the image surface of the document D being passing over the image reading position 13. Whereby the scanned image is formed on the CCD device 25 and document image information which is optical information of the scanned image is converted into electrical information. The converted document image information is subjected to processes of A/D conversion, shading correction, compression, and so on and is stored in a memory M1 of a control unit C1.

The writing unit 3 is a scanning optical system comprising a laser light source, a cylindrical lens, and a Fθ lens, a mirror, a polygon mirror, etc. And, the writing unit 3 scans over a surface of a photoreceptor 41 of the image forming unit 4 with a laser beam that varies in accordance with the image information read from the memory M. Whereby the writing unit 3 forms a latent image on the surface of the photoreceptor 41.

The image forming unit 4 carries out a developing operation for the latent image formed on the surface of the photoreceptor 41 in a developing unit 42 and visualizes it as a toner image. An image transferring unit 43 transfers the toner image onto a sheet P sent out by a registration roller 81. After the toner image has been transferred from the surface of the photoreceptor 41, the surface of the photoreceptor 41 is cleaned by a cleaning unit 44 so as to remove residual toner and charged by an electrostatic charging unit 45. And thereafter the surface of the photoreceptor 41 is provided to a next latent image formation.

A fixing unit 5 fixes the toner image on the sheet P by heating and applying pressure on the sheet P carrying the toner image by the use of a heating roller 51 and a pressure roller 52 which are placed opposite to each other.

The sheet P on which the image fixing has been completed is sent to a bookbinding apparatus B by a sheet discharging roller 55.

When discharging the sheet after reversing it, the sheet P is guided downwards by a sheet discharging guide 57. And then, a trailing edge of the sheet P is pinched and held by a reversing roller 61 of a reversing unit. Whereby the sheet is reversed and sent out to the sheet discharging roller 55.

When carrying out an image formation on both sides of a sheet P, the sheet P is sent to a re-feeding unit 7 via the sheet discharging guide 57 and a plurality of rollers. Then, the sheet P is reversed by the reversing roller 71 of the re-feeding unit 7, and is sent out again to the sheet transporting unit 8.

The sheet transporting unit 8 transports a sheet P fed out from a sheet feeding unit by a sheet transporting path constructed by a plurality of rollers and a guide member. And, the sheet transporting unit 8 further transports it toward a photoreceptor to make it to receive a toner image after bring a leading edge of the sheet P in contact with a registration roller.

The sheet feeding unit 9 is configured to comprise the first sheet feeding unit 91 that has a small capacity tray, the second sheet feeding unit 92 that has a large capacity tray, and the third sheet feeding unit 93. Each of the sheet feeding units has respective feeding rollers 916, 926, and 936 each of which feeds out a sheet P stacked in each tray one by one toward the sheet transporting unit 8. In addition, in each of the second sheet feeding unit 92 and the third sheet feeding unit 93, there is provided a top surface detection unit that detects the position of the top surface of stacked papers. Then, the control unit C1 moves up or down the bottom surface of the tray in which sheets P are stacked, based on the top surface detection signal from the detection unit.

The operation and display unit E is a touch panel installed on the top surface of the main body of the image forming apparatus A and has both functions of inputting and displaying. Therefore, the operation and display unit E is used to conduct an instructing operation for a control unit C1 with regard to setting a bookbinding mode, such setting the number of copies and setting whether or not to carry out a bookbinding operation. In addition, this unit also has a function of displaying warm-up information described later.

If the bookbinding mode has been selected by using the operation and display unit E, a sheets P on which an image formation has been done by the image forming apparatus A and which have been sent out to the bookbinding apparatus is guided by a separation guide 101 to proceed upward and discharged onto a sheet discharging tray 102.

When the bookbinding mode has been selected, plural sheets to be bound are serially conveyed to a sheet aligning unit 200 and thereby being stacked. In addition, it is possible that a cover sheet or a insert sheet to be inserted between specific pages is stacked in sheet stacking units 910 and 920 and the sheet transporting unit 100 conveys these sheets to the sheet aligning unit 200. Whereby these sheets are inserted at a position of a specific page number of the plural sheets stacked by the sheet aligning unit 200.

The sheet aligning unit 200 is configured to comprise a sheet stacking tray 201, a leading edge aligning plate 202, a sheet pressing members 203 and 204, a roller 205, and a sheet width aligning plate (not shown in the figure), etc. Sheets P stacked in the stacking tray 201 have their leading edges aligned by the leading edge aligning plate 202 and their both side edges aligned by the width aligning plate, thereby becoming an aligned stack of sheets. A binding unit 300 described later conducts a binding operation for this aligned stack of sheets, whereby the bookbinding operation is completed.

When the stacking of the last page is completed, sheet pressing members 203 and 204 press a leading edge portion of a stack of sheets P from both of top and bottom surfaces of the stack of sheets P. Whereby the stack of sheets is tightly pinched such that the alignment of the stacked sheets does not collapse. When this pinching by the sheet pressing members 203 and 204 has been completed, the leading edge aligning plate 202 moves in the direction of an arrow "b" shown in the drawing. As a result, the leading edge of the stack of sheets faces against the binding unit 300 with a binding tape TT placed in between them.

Figure 2:
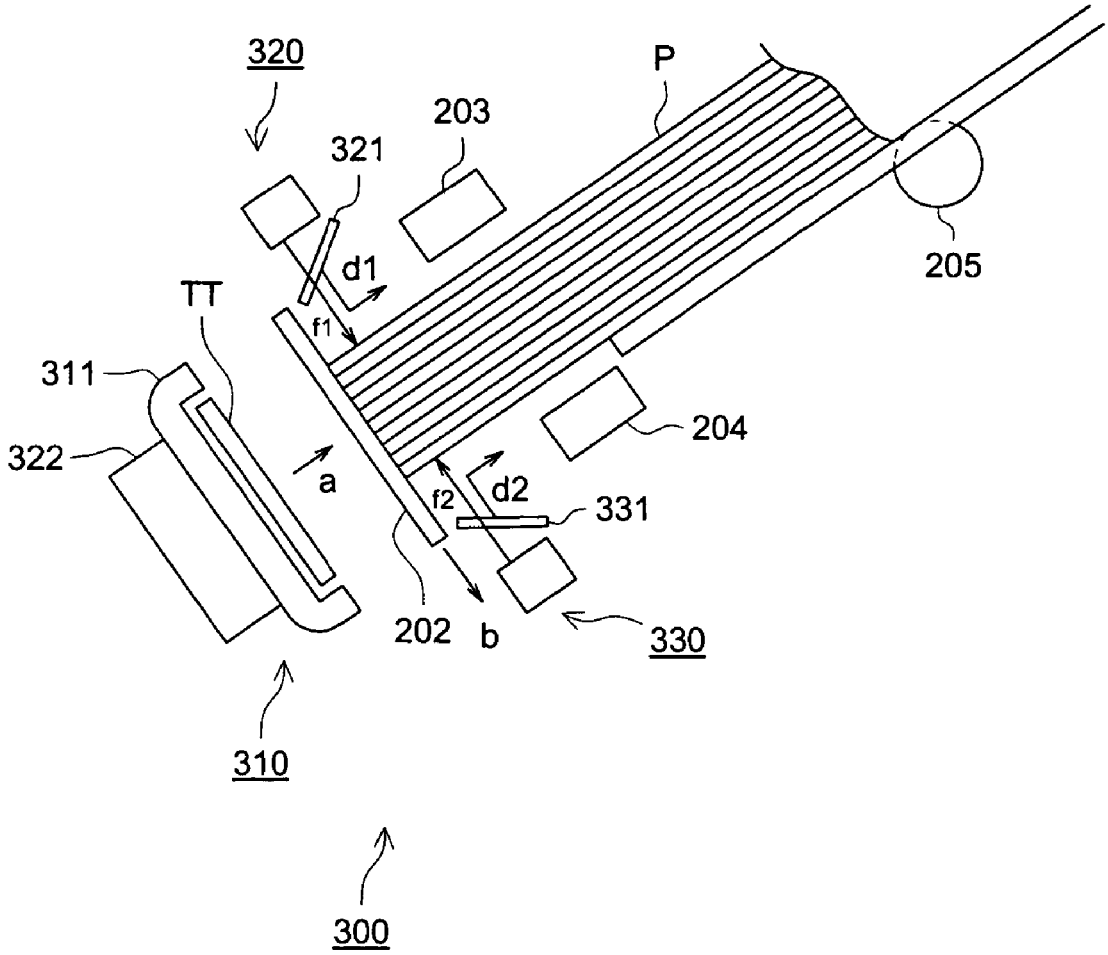
FIG. 2 is a schematic diagram showing the peripheral parts near the binding unit.

FIG. 2 is a schematic diagram showing the peripheral parts near the binding unit 300.

The binding unit 300 is configured to comprise a binding tape TT that is coated with a hot-melt type adhesive; a binding tape transporting unit (not shown in FIG. 2 but shown in FIG. 3) that cuts the binding tape TT to a specific length and sends it from a tape supply roll section (not shown in the figure) to a main heater unit 310; the main heater unit 310 that presses the binding tape TT from a back surface of it against a leading edge surface of the aligned stack of sheets while heating it; and side surface heating units 320 and 330 that press both side surfaces of the binding tape TT onto the top surface and the bottom surface of the stack of sheets while heating it.

The main heating unit 310 is configured to comprise a heating member 311, a heater 312, and a temperature detection unit TS1 (not shown in FIG. 2 but shown in FIG. 3), etc. The heating member 311 is controlled to maintain a specific temperature by the temperature detection unit TS1 and the control unit C2. Further, although the side surface heating units 320 and 330 are different in shape from the main heating unit 310, they are constructed by heating members, heaters, and temperature detection units as similar as the main heating unit 310.

After the heating has been started for the heating member 311, when the temperature detection unit TS1 detects that the temperature of the heating member 311 has reached the melting temperature of the hot-melt adhesive, the control unit C2 transmits warm-up completion information to a control unit C1 of the image forming apparatus.

The main heating unit 310 of the binding unit 300 is moved by a heating unit moving unit (not shown in the drawings) in the direction of an arrow "a" shown in the drawings, and presses the binding tape TT against the leading edge surface of the stack of sheets. With this operation, the adhesive of the binding tape TT melts and transfers to the leading edge surface of the stack of sheets.

Next, binding tape side surface guides 321 and 331 are moved in the directions of arrows d1 and d2 respectively, and bend the side surfaces of the binding tape towards the topmost surface and the bottommost surface of the stack of sheets. When the movements of the binding tape side surface guides 321 and 331 are completed, side surface heating units 320 and 330 are moved in the directions of arrows f1 and f2 respectively, and press the both bent side surfaces of the binding tape TT onto the topmost surface and the bottommost surface of the stack of sheets while heating the both bent side surfaces of the binding tape TT.

When a previously set pressing time has elapsed, the main heating unit 310 and the side surface heating units 320 and 330 return to their original positions and then separate from the stack of sheets. With this operation, the temperature of the melted adhesive of the binding tape TT drops suddenly thereby the adhesive harden. Accordingly, the stack of sheets is bound at its leading edge surface by the hardened adhesive.

The sheet aligning unit 200 is moved to the position shown by dotted lines in FIG. 1 while still holding the bound stack of sheets by the pressing members 203 and 204. Thereafter, the pressing by the pressing members 203 and 204 is released, and a roller 205 provided on the stacking tray 201 is raised above the stacking surface and rotated so that the bound stack of sheets is transported to a bound sheet stack loading tray 400.

Figure 3:
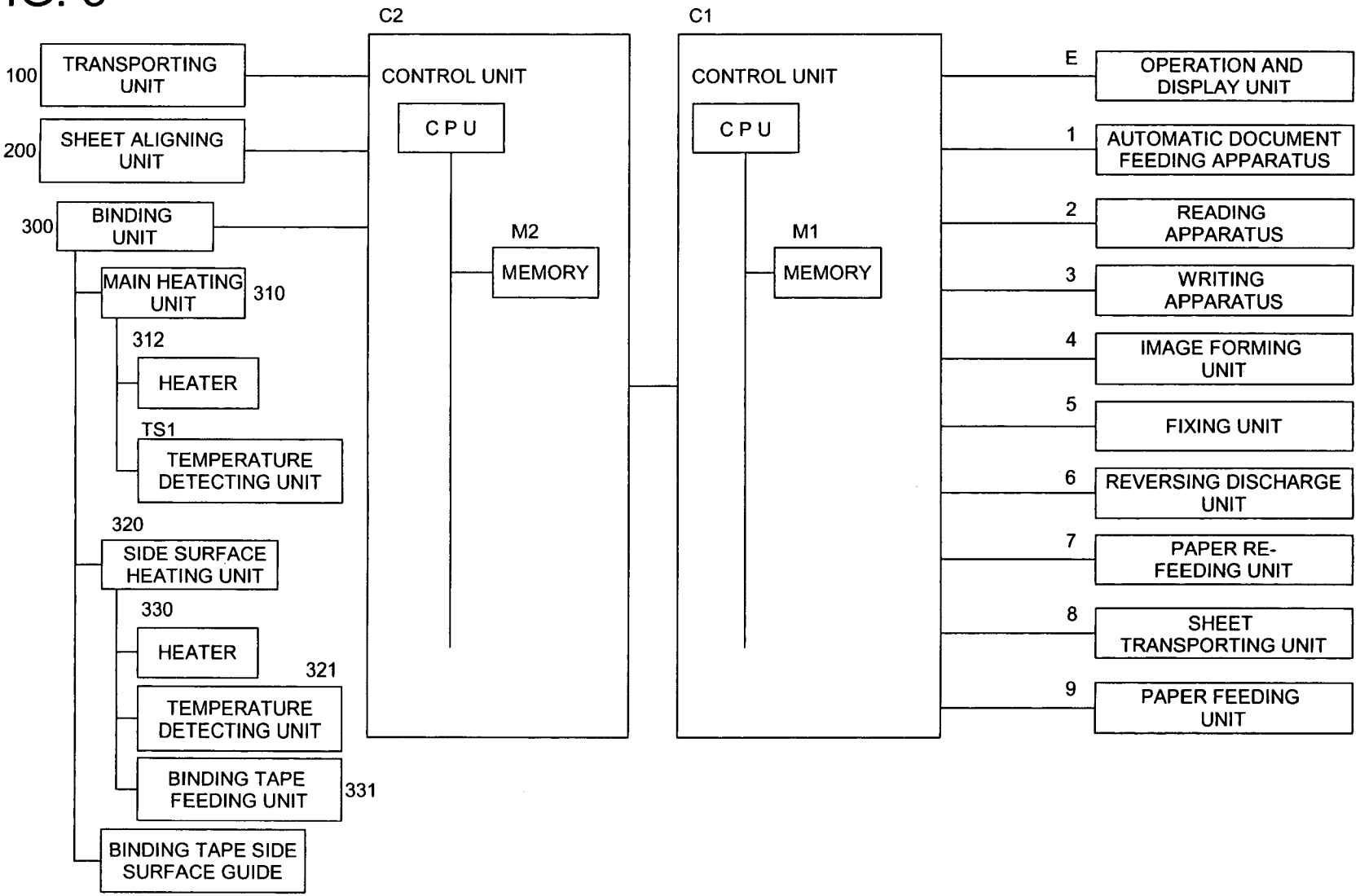
FIG. 3 is a block diagram showing the controls of the image forming system.

FIG. 3 is a block diagram showing a control relationship of the image forming system comprising the image forming apparatus A and the bookbinding apparatus B according to the present embodiment.

A control unit C1 of the image forming apparatus is a computer system that is configured to comprise a CPU, an operation unit, a memory unit M1, an input/output I/F (interface), a communication unit, and drive circuits, etc. Programs having been stored beforehand in the memory unit M1 are executed so that the control for each of these units is carried out. In addition, the input/output interface is connected with an input port for receiving the warm-up completion information transmitted by the control unit C2 of the binding apparatus. Further, a control unit C2 of the binding apparatus comprises a structure which is smaller than the structure of the control unit C1, but is almost the same with it. The input/output I/F is connected with an output port for transmitting the warm-up completion information. Incidentally, the description of blocks that are not necessary for explaining the present preferred embodiment has been omitted.

Figure 4:
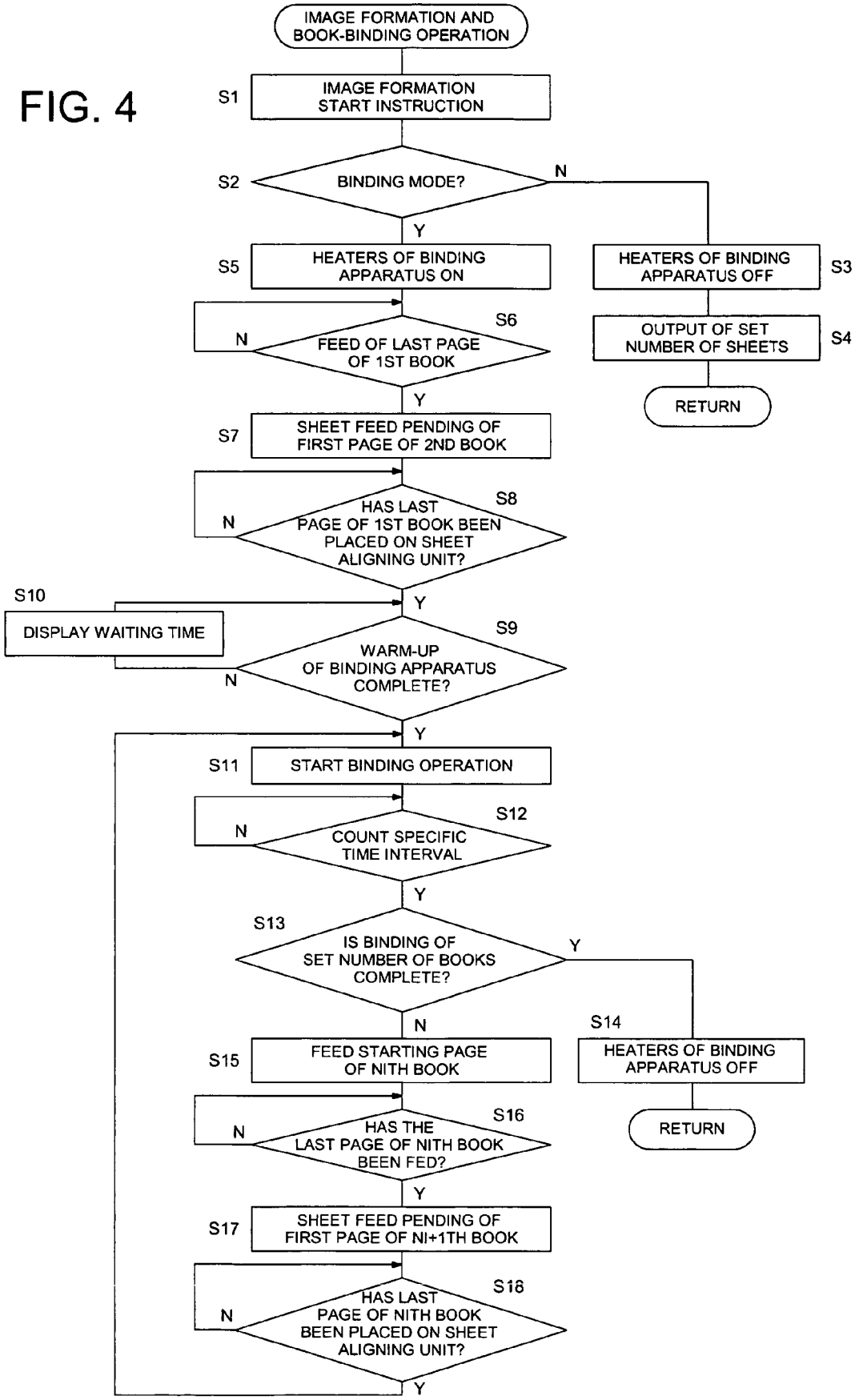
FIG. 4 is a flow chart showing the flow of controls of the image forming system.

FIG. 4 is a flow chart showing the flow of detecting the warm-up state of the binding apparatus and controlling the image forming system based on the results of the detection.

Firstly, when an instruction for an image forming operation is input from the operation and display unit E of the image forming apparatus A (Step S1), the control unit C1 detects whether or not a bookbinding mode has been set in the operation and display unit E (Step S2).

When the bookbinding mode has not been selected (Step S2: N), the control unit C1 sends the non-selection information to switch off the bookbinding apparatus to the control unit C2. Upon receipt of this non-selection information, the control unit C2 moves a separating guide 101 to a predetermined position so as to discharge sheets, on which images are formed, onto the sheet discharging tray 102 of the bookbinding apparatus B. Further, the control unit C2 also switches OFF heaters of the main heating unit 310 and the side surface heating units 320 and 330 of the binding unit 300 (Step S3). The image forming apparatus A carries out image formations of the number of sheets set in the operation and display unit E and discharges the sheets onto the sheet discharging tray 101 of the bookbinding apparatus B (Step S4).

When the bookbinding mode has been selected (Step S2: Y), the control unit C1 sends to the control unit C2 information that the bookbinding apparatus B has been selected. Then, the control unit C2 having received the information switches ON the heaters provided in the heating units of the binding unit 300 (Step S5).

After waiting until a sheet P becoming the last page of the first copy of a book to be bound is fed to an image formation (Step S6), the control unit C1 keeps a sheet P becoming the first page of the next second copy of the book on a sheet feed standby state (Step S7). When the sheet P becoming the last page of the first copy of the book is stacked in the sheet aligning unit 200 (Step S8: Y), the warm-up situation of the binding unit 300 is judged by the control unit C2 (Step S9). If the warming up has not been completed (Step S9: N), a waiting time until the warming up has been completed is indicated on the operation and display unit E (Step S10), and completion of the warming up is awaited (Step S9). If the warming up has been completed (Step S9: Y), the binding unit 300 starts a binding operation for the first copy of the book (Step S11) and also stars a timer to count a predetermined time period necessary for the binding operation (Step S12).

When the counting of the predetermined time period by the timer has been completed (Step S12: Y), confirmation is made for whether or not the binding for the set number of copies of the book has been completed (Step S13). Then, if it has been completed (Step S13: Y), all the heaters of the binding unit 300 are switched OFF (Step S14) and the control escapes from this routine. If it has not been completed (Step-S13: N), feeding a sheet is conducted for forming an image of the first page of a next successive copy of the book (the second copy of the book in the current example, but referred as the $N_i^{th}$ copy of the book for generalization) (Step S15). When a sheet P becoming the last page of the $N_i^{th}$ copy of the book has been fed out (Step S16: Y), a sheet becoming the first page of the $N_{i+1}^{th}$ copy of the book following the $N_i^{th}$ copy of the book is kept on the sheet feed standby state (Step S17). And then, the control waits until a sheet becoming the last page of the $N_i^{th}$ copy of the book is stacked in the sheet aligning unit 200 (Step S18). Thereafter, the control returns to Step 11 and the similar operations are continued until the bookbinding for the set number of copies of the book has been completed.

In the above embodiment, although feeding a sheet becoming the first sheet of the second copy of the book is kept in a standby condition (Step S7) after a sheet becoming the last page of the first copy of the book has been fed out, it is not necessary to carry out the control in this manner. For example, in order to improve the work efficiency of the bookbinding apparatus after the warming up process has been completed, it may be considered to provide at an upstream side of the sheet aligning unit a stacking tray capable of holding the number of sheets on which images are formed during the predetermined time period for conducting the bookbinding operation. In the case of such a configuration, it may be possible to control as follows. Feeding a sheet for the second copy of the book is continued even after a sheet becoming the last page of the first copy of the book is fed out. And then, sheets on which image formations have been completed are stacked in the stacking tray. Incidentally, when the stacking tray becomes full even before the warming up process has been completed, it is necessary at that time to control to make feeding a sheet for the second copy to be on a standby condition.

Namely, it is possible to speed up starting the bookbinding operation for the first copy of the book by the following controlling manners: With regard to sheets for the first copy, regardless of the warm-up information of the bookbinding apparatus, sheets are stacked in the sheet aligning unit 200. And then, with regard to sheets for the second copy of the book, operations of the image forming apparatus are controlled based on the warm-up information of the bookbinding apparatus.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus being capable of connecting to a finisher which requires a warm-up process before use, said image forming apparatus comprising:

an input port which inputs warm-up information from the finisher; and a controller which controls the image forming apparatus to transport a first set of sheets to the finisher regardless of the warm-up information and control an image forming process for a second set of sheets based on the warm-up information, said first set of sheets being subjected to a first finishing operation carried out only after completing the warm-up process and said second set of sheets being subjected to a second finishing operation following the first finishing operation.

2. An image forming apparatus as claimed in claim 1, wherein the warm-up information is warm-up completion information.

3. An image forming apparatus as claimed in claim 2, wherein the controller changes start timing of the image forming process for the second set of sheets according to the warm-up completion information.

4. An image forming apparatus as claimed in claim 1, the finisher binds a set of sheets with a hot melt adhesive.

5. An image forming apparatus as claimed in claim 4, wherein the warm-up information relates to temperature of the hot melt adhesive.

6. An image forming apparatus as claimed in claim 5, wherein the warm-up information is warm-up completion information which is output when the temperature of the hot melt adhesive reaches a predetermined value for melting the hot melt adhesive.

7. An image forming apparatus as claimed in claim 1, further comprising a display panel for displaying the warm-up information.

8. An image forming system with an image forming apparatus and a finisher which is capable of connecting to the image forming apparatus and requires a warm-up process before use, said image forming system comprising:

the finisher which comprises:

an output port which outputs warm-up information to the image forming apparatus;

the image forming apparatus which comprises:

an input port which inputs warm-up information from the finisher; and a controller which controls the image forming apparatus to transport a first set of sheets to the finisher regardless of the warm-up information and control an image forming process for a second set of sheets based on the warm-up information, said first set of sheets being subjected to a first finishing operation carried out only after completing the warm-up process and said second set of sheets being subjected to a second finishing operation following the first finishing operation.

9. An image forming system as claimed in claim 8, wherein the warm-up information is warm-up completion information.

10. An image forming system as claimed in claim 8, the finisher binds a set of sheets with a hot melt adhesive.

11. An image forming system as claimed in claim 10, wherein the warm-up information relates to temperature of the hot melt adhesive.

12. An image forming system as claimed in claim 11, wherein the warm-up information is warm-up completion information which is output when the temperature of the hot melt adhesive reaches a predetermined value for melting the hot melt adhesive.

13. An image forming system as claimed in claim 8, further comprising a display panel for displaying the warm-up information.

* * * * *